US006780046B2

(12) United States Patent
Bach et al.

(10) Patent No.: US 6,780,046 B2
(45) Date of Patent: Aug. 24, 2004

(54) FLEX CABLE CONNECTION SYSTEM COMPRISING A SPRING HOUSING

(75) Inventors: Friedrich Bach, Lauf An Der Pegnitz (DE); Michael Hopf, Nuremberg (DE); Robert Janitschke, Nuremberg (DE)

(73) Assignee: FCI, Paris (FR)

( * ) Notice: Subject to any disclaimer, the term of this patent is extended or adjusted under 35 U.S.C. 154(b) by 103 days.

(21) Appl. No.: 10/108,800

(22) Filed: Mar. 27, 2002

(65) Prior Publication Data

US 2002/0160642 A1 Oct. 31, 2002

(30) Foreign Application Priority Data

Mar. 28, 2001 (DE) ..... 101 15 283

(51) Int. Cl.[7] ..... H01R 9/07
(52) U.S. Cl. ..... 439/495
(58) Field of Search ..... 439/495, 67

(56) References Cited

U.S. PATENT DOCUMENTS 4,248,491 A * 2/1981 Mouissie ..... 439/495
4,634,195 A * 1/1987 Shoemaker ..... 439/493
4,647,125 A 3/1987 Landi et al. ..... 339/17 F
5,954,537 A * 9/1999 Sonobe et al. ..... 439/495

FOREIGN PATENT DOCUMENTS

| | | |
|---|---|---|
| DE | 1200408 C | 9/1965 |
| DE | 198 32 011 | 2/2000 |
| DE | 19832012 A1 | 2/2000 |
| DE | 19910572 A1 | 9/2000 |
| FR | 1 236 251 | 6/1960 |
| GB | 1 317 264 | 5/1973 |
| GB | 1 327 194 | 8/1973 |

* cited by examiner

*Primary Examiner*—Tulsidas Patel
*Assistant Examiner*—Phuong Dinh
(74) *Attorney, Agent, or Firm*—Perman & Green, LLP

(57) ABSTRACT

The invention relates to a connection system for flexible flat strip cables (1*a*,1*b*) with parallel strip conductors lying at a distance from one another which are bared in the contact area (4), with a first housing part (2*a*) on whose floor (3) is fastened a principal flexible flat strip cable (1*a*) and a second housing part (2*b*) in which a branch flexible flat strip cable is fixed, with flexible tongues (5) which press the bared area of the branch flexible flat strip cable (1*b*), with the housing parts (2*a*,2*b*) in the inserted state, against the bared area of the principal flexible flat strip cable (1*a*).

8 Claims, 4 Drawing Sheets

FLEX CABLE CONNECTION SYSTEM COMPRISING A SPRING HOUSING

The present invention relates to a connection system for flexible flat strip cables comprising parallel strip conductors lying at a distance from one another and each bared in an area of contact. The connection system has a two-part housing, which can be clipped shut and in which connection takes place between a main flat strip cable and a branch flat strip cable.

Such flat strip cables are used in vehicle multiplex systems, where, for example, they are to be led from a ring circuit, which carries current and signals on various strip conductors, to individual consuming points or sensors and similar branch conductors which also consist of flat strip cables. There is a requirement for a maximally flexible and easily handled connection system, whereby the said branches can be introduced at any point of the main flat strip conductor.

It is, accordingly, the purpose of the present invention to provide a connection system for flexible flat strip cables, which can be introduced and rapidly and easily fitted at any point of a flexible flat strip cable.

This purpose is reached according to the Claims.

The characteristics of preferred embodiments are described in the subsidiary Claims.

The present invention is based on the idea of fitting a two-part clip on the principal flat strip conductor, where in the case of previously appropriately bared contact areas, a part of the clip already contains the end of a branch connection and the electrical connection is established by means of the mutual insertion of the two parts onto the principal flat strip cable and the pressing of the respective contact areas into one another.

The invention is explained below in greater detail by means of the description of an embodiment and by referring to diagrams.

Figure 1:
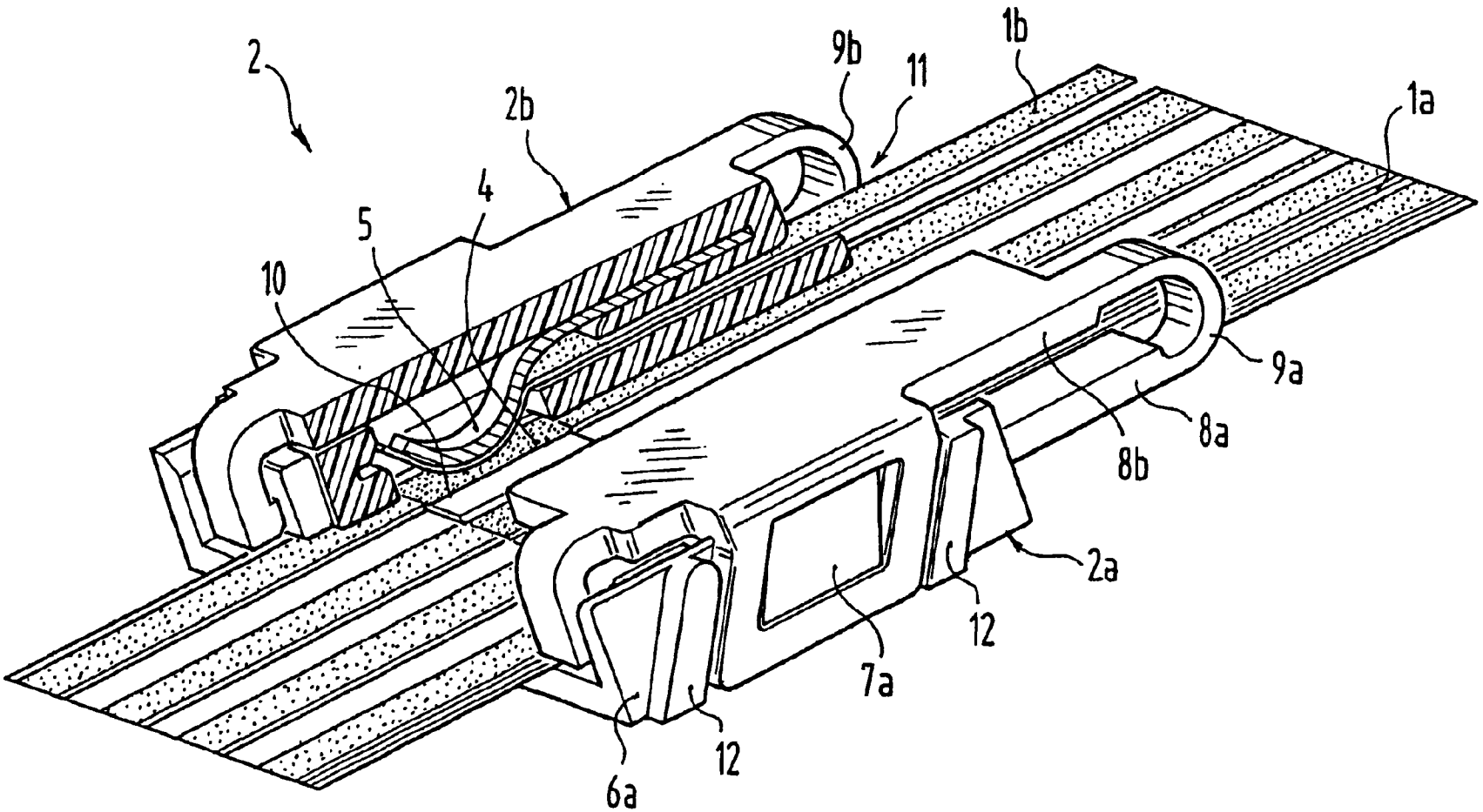
Figure 2B:
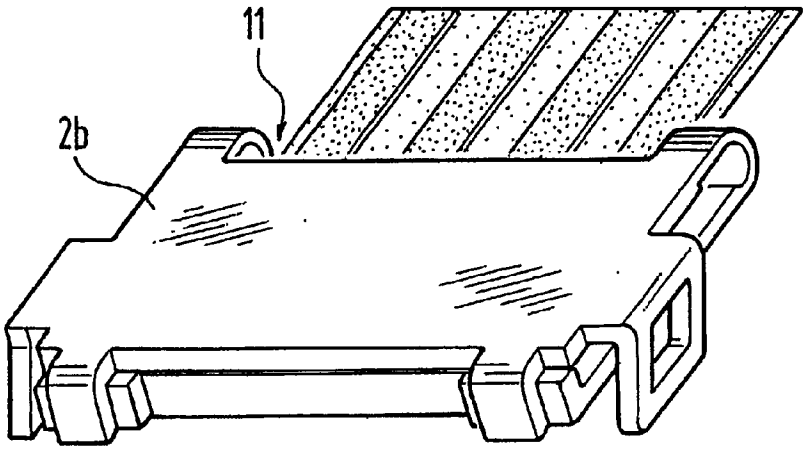
Figure 2A:
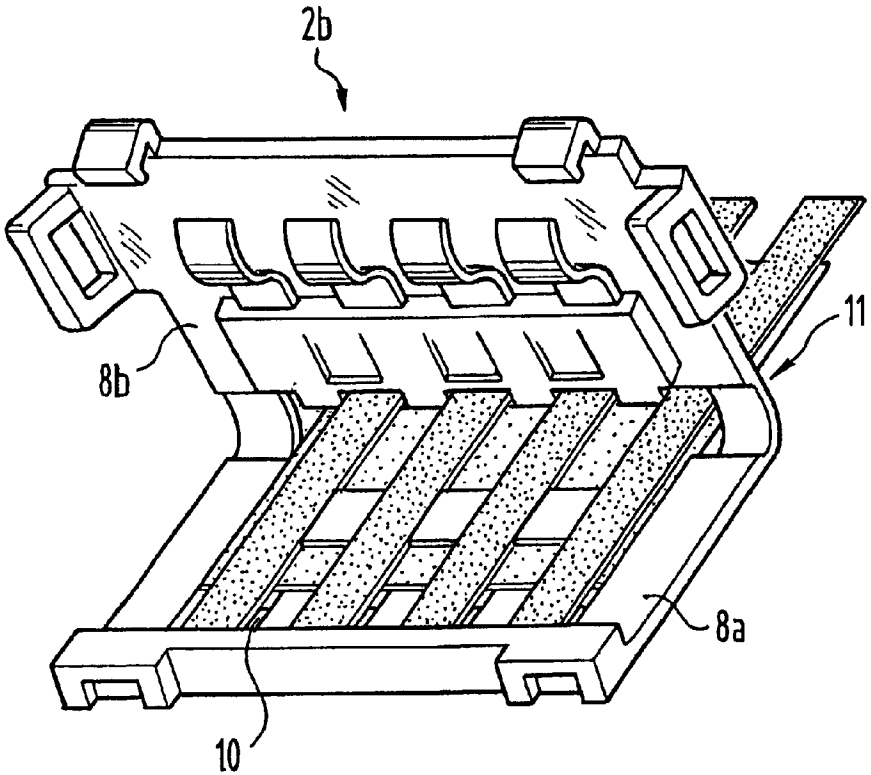
Figure 2C:
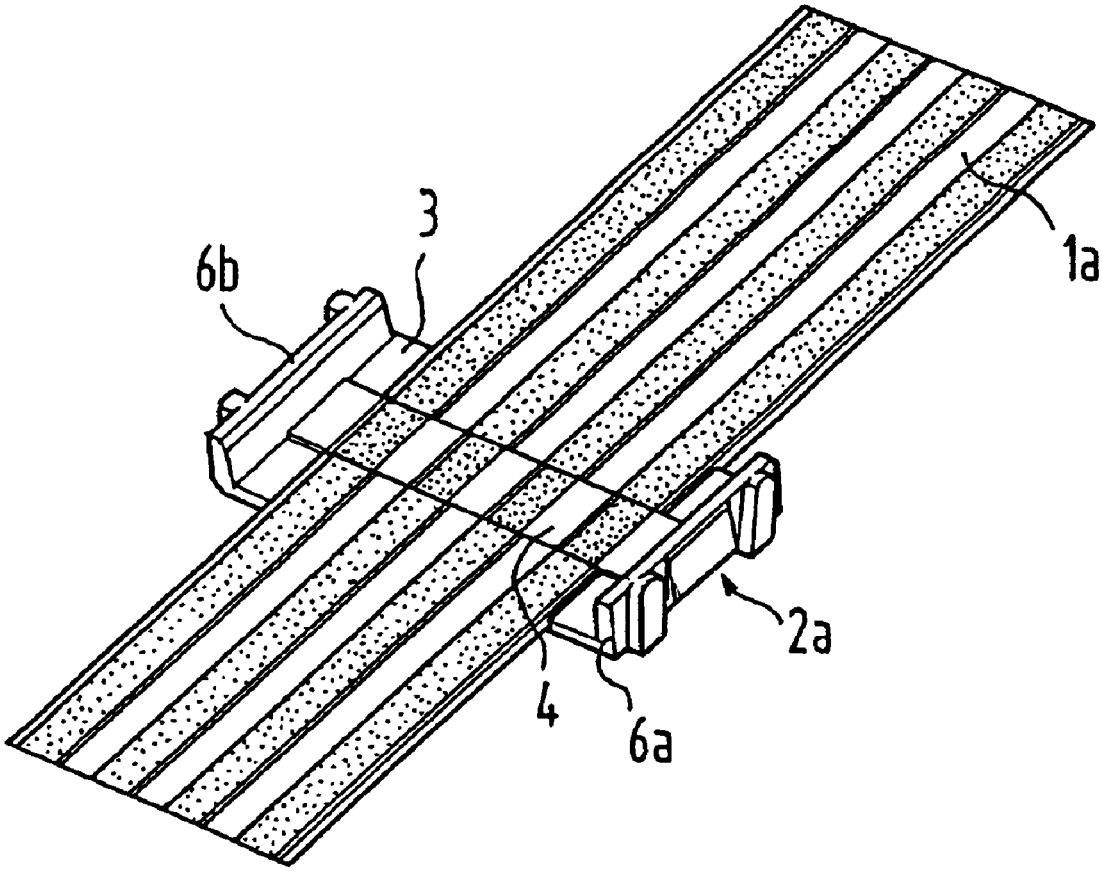
Figure 2D:
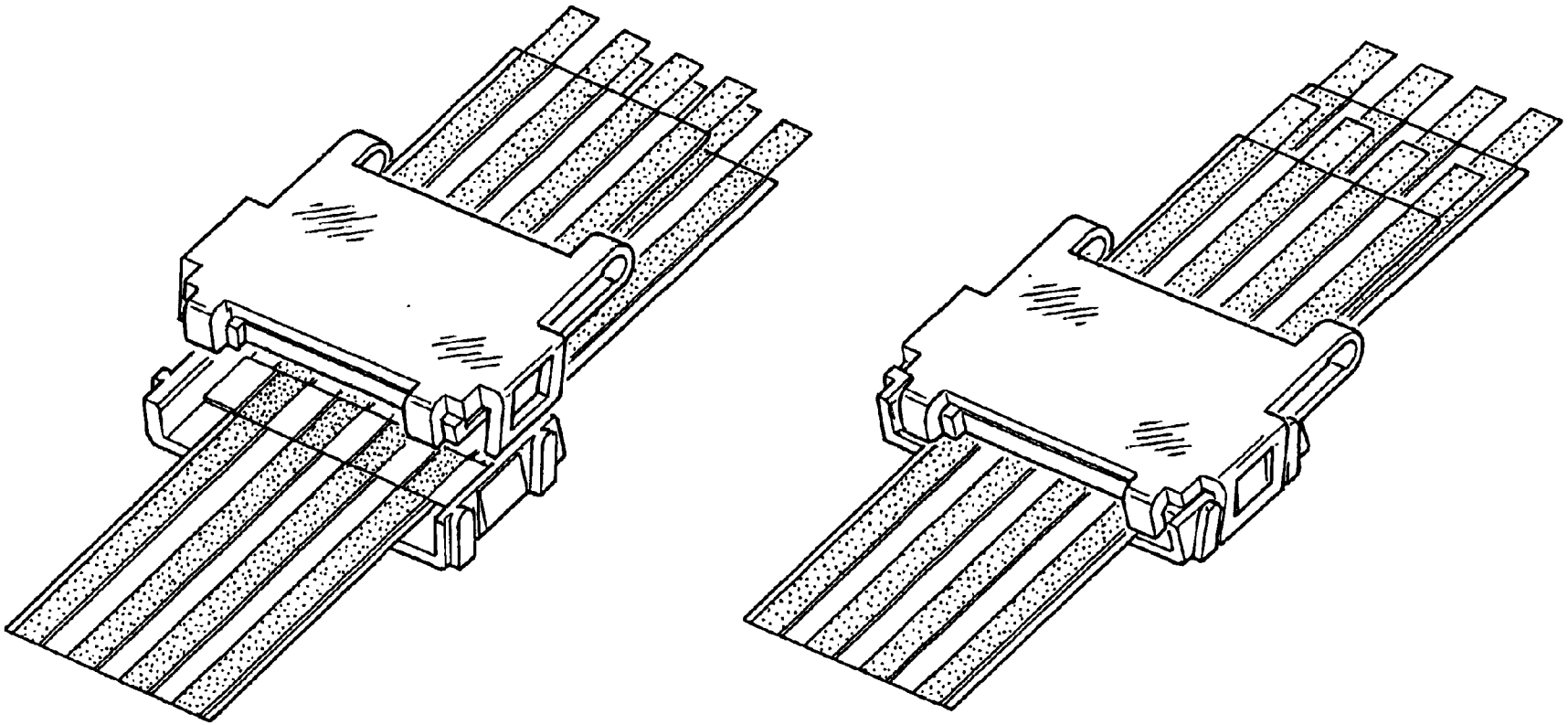

FIG. 1 shows in perspective a partial section view of an embodiment of the connection system according to the invention ; and FIGS. 2*a* to 2*d* show the process of assembly of the connection system according to the invention.

FIG. 1 shows a principal flexible flat strip cable 1*a*, on which is inserted the connection system according to the invention with an end of a branch flexible flat strip cable 1*b*. The connection system has a housing 2 with a lower first housing part 2*a* and an upper housing part 2*b*. The lower housing part 2*a*, which is shown separately in FIG. 2*c*, has a floor 3 with catch stops (not shown) which snap into recesses provided in the flat strip cable 1*a* and so exactly fix the position of the flat strip cable 1*a* in relation to the lower housing part 2*a*, whereby the bared contact areas 4 are also exactly fixed. The lower housing part 2*a* also has two side walls 6*a*, 6*b* opposite one another fitted with means of locking for the clipping on of the second housing part 2*b*. The second housing part 2*b* has a lower portion 8*a* and an upper portion 8*b* which are linked together by bendable bridges 9*a*,9*b*. An end of the branch flat strip cable into the second housing part 2*b* is passed between the connection bridges 9*a*,9*b*, until its reaches its front edge. The contact areas of the branch flat strip cable 1*b* which are also bared, lie above an opening 10 in the lower portion 8*a* of the second housing part 2*b*. The upper portion 8*b* is swung onto the lower portion 8*a* via the connection bridges 9*a*,9*b* and the second housing part is locked with the first housing part by snapping into the latter. The upper portion has a flexible tongue 5, whose free end is arc-shaped and whose convexity penetrates elastically into the contact area of the branch flat strip cable 1*b* through the opening 10 in the lower part 2*b*. The branch flat strip cable 1*b* is gripped between the upper portion 8*b* and the lower portion 8*a* and appropriately precisely adjusted for position in the recesses provided in the branch flat strip cable 1*b* by the catch stops. If the stopped end of the branch flat strip cable 1*b* of the second housing part 2*b* is now inserted into the first housing part, the contact areas of both the cables will lie exactly over one another and are pressed against one another by the free end of the flexible tongue 5.

FIG. 2 shows the process of assembly. According to FIG. 2*a*, the branch flat strip cable 1*b* is first inserted into the second housing part 2*b*, adjusted as described earlier and the second housing part 2*b* is closed as shown in FIG. 2*b*, whereby the upper part and the lower part lock together on the front face. Now, the closed upper housing part 2*b* is clipped on the housing part 2*a* on which the principal flat strip cable 1 is already fastened and the flexible tongues above the strip conductors press together the contact faces of the two cables and thus establish electrical contact.

As FIG. 1 shows, the clipping of the second housing part to the first housing part takes place by means of a bracket, which is arranged on a snap-in nose 7*a* located on the sidewall of the lower housing part 2*a*. The bracket is passed between two guide ribs 12, which are arranged diagonally to the vertical with respect to the flat strip cable 1*a*. This produces, during the insertion movement between the first mutual touch of the contact faces and attainment of the locked end-position, a wiping movement of the contact faces against one another in the direction of the axial cable, so that the contact faces can rid one other of oxide layers or soiling and the electrical transition resistance of this contact becomes smaller.

Thus, the connection system according to the invention represents a simple solution, which makes possible rapid assembly and a secure electrical connection.

The above description of an embodiment example only serves as an illustration of the present invention and is not to be understood as in any way limiting.

What is claimed is:

1. A connection system for flexible flat strip cables with parallel strip conductors placed at a distance from one another, which are bared in the contact area, comprising a first housing part on whose floor is fastened a principal flexible flat strip cable and a second housing part in which is fixed a branch flexible flat strip cable with flexible tongues which, in the inserted state of the housing parts, press the bared area of the branch flexible flat strip cable against the bared area of the principal flexible flat strip cable, wherein the second housing part has a lower portion and an upper portion which is connected thereto by bendable bridges, where the lower portion has means of fixing an end of a branch flexible flat strip cable and an opening in the area of the contact areas on the flat strip cable and the upper portion is able to be swung and lowered over the bridges onto the lower portion and shaped so as to be able to be locked and has, above the opening in the lower portion, bulging flexible tongues which press the branch flat strip cable, through the opening, onto the principal flat strip cable.

2. A connection system according to claim 1, wherein the first housing part has two sidewalls lying opposite one another, with means of locking for the removable fastening of the second housing part, the sidewalls being resiliently flexible for releasing the means of locking.

3. A connection system according to claim 1, wherein the second housing part between the connecting bridges and between the upper portion and the lower portion, an insertion slot is provided and the exact position fixing of the branch cable which is firmly gripped between the upper portion and the lower portion, takes place via the catch stop in the lower portion and appropriately shaped recesses in the branch cable.

4. A connection system according to claim 1, wherein the flexible tongue is a flat steel spring whose free end is arc-shaped and penetrates into the opening and whose opposite end is cast or pressed into the upper portion.

5. A connection system according to claim 2, wherein the means of locking are formed on a housing portion via of a bracket on the other housing portion led between diagonal guide ribs, where a wiping effect occurs through the diagonal locking, on the contact areas which are to be pressed together.

6. A connection system according to claim 2, wherein the second housing part has a lower portion and an upper portion which is connected thereto by bendable bridges, where the upper portion has means of fixing an end of a branch flexible flat strip cable and an opening in the area of the contact areas on the flat strip cable and the upper portion is able to be swung and lowered over the bridges onto the lower portion and shaped so as to be able to be locked and has, above the opening in the lower portion, bulging flexible tongues above every strip conductor, which press the branch flat strip cable, through the opening, onto the principal flat strip cable.

7. A connection system according to claim 6, wherein the second housing part between the connecting bridges and between the upper portion and the lower portion, an insertion slot is provided and the exact position fixing of the branch cable which is firmly gripped between the upper portion and the lower portion, takes place via the catch stop in the lower portion and appropriately shaped recesses in the branch cable.

8. A connection system according to claim 6, wherein the flexible tongue is a flat steel spring whose free end is arc-shaped and penetrates into the opening and whose opposite end is cast or pressed into the upper portion.

* * * * *